US005711044A

United States Patent [19]

Newman et al.

[11] Patent Number: 5,711,044

[45] Date of Patent: Jan. 27, 1998

[54] PATIENT TRANSFER ASSIST DEVICE

[75] Inventors: William Chris Newman, Missoula, Mont.; George D. Tipp, National City, Calif.

[73] Assignee: Nu-Way Products, Inc., Missoula, Mont.

[21] Appl. No.: 680,386

[22] Filed: Jul. 15, 1996

Related U.S. Application Data

[63] Continuation-in-part of Ser. No. 546,455, Oct. 20, 1995, abandoned.

[51] Int. Cl.[6] ..... A61G 7/10

[52] U.S. Cl. ..... 5/81.1 T; 5/89.1

[58] Field of Search ..... 5/81.1 R, 81.1 T, 5/89.1; 294/140, 150, 154, 155, 156

[56] References Cited

U.S. PATENT DOCUMENTS

| | | | |
|---|---|---|---|
| 3,458,878 | 8/1969 | Combs | 5/81.1 T |
| 4,012,799 | 3/1977 | Rutherford | 5/81 R |
| 4,944,057 | 7/1990 | Shaw | 5/89.1 |
| 5,271,110 | 12/1993 | Newman | 5/81 R |
| 5,297,834 | 3/1994 | Vanarnem | 294/140 |
| 5,442,821 | 8/1995 | Weeks | 5/89.1 X |

FOREIGN PATENT DOCUMENTS

| | | | |
|---|---|---|---|
| 2213734 | 8/1989 | United Kingdom | 5/81.1 T |

*Primary Examiner*—Michael F. Trettel
*Attorney, Agent, or Firm*—Harry M. Cross, Jr.

[57] ABSTRACT

A person transfer assist device is provided for use to help a person transfer from a sitting position to a standing position and from a standing position to a sitting position which comprises: a) a pad for fitting around the lower back and waist of a person to be assisted; b) a grip bar having a length sufficient to enable an attendant and the person to be assisted to grip the bar during use of the device; and c) a strap secured to the pad and to the grip bar, the strap having a sufficient length so as to enable an attendant to stand before a person to be assisted and to pull such a person from a sitting position to a standing position, or to lower such a person from a standing position to a sitting position, while maintaining an upright posture. A waist strap may be provided to attach the pad around the lower back and waist of the person requiring assistance.

20 Claims, 5 Drawing Sheets

FIG. 5
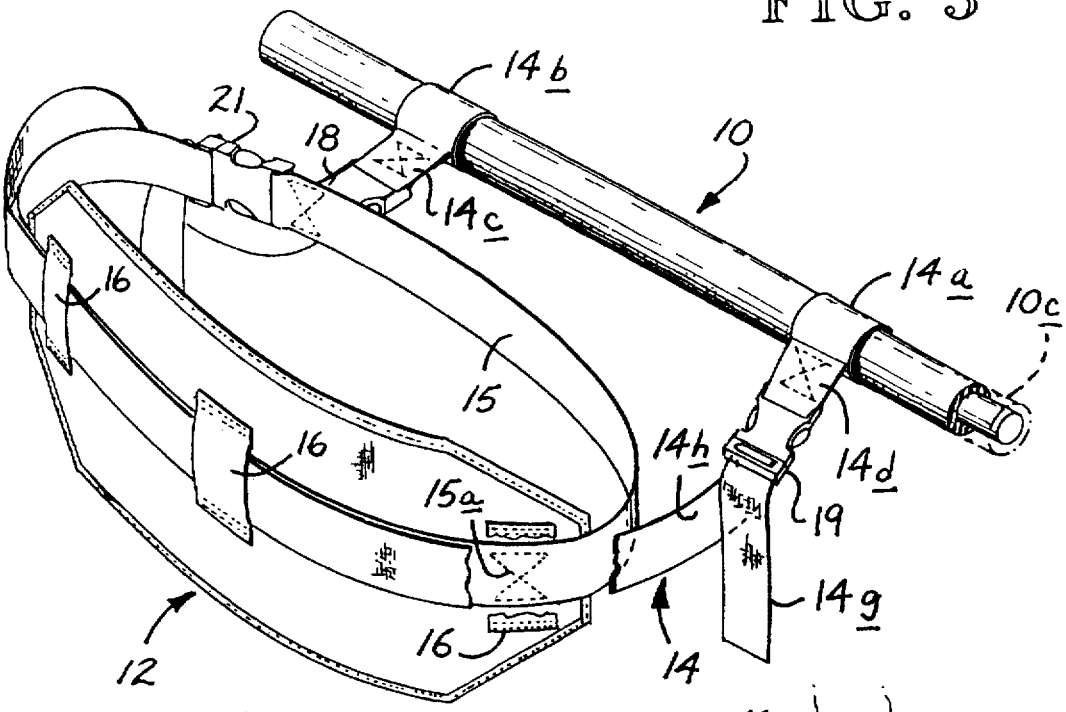
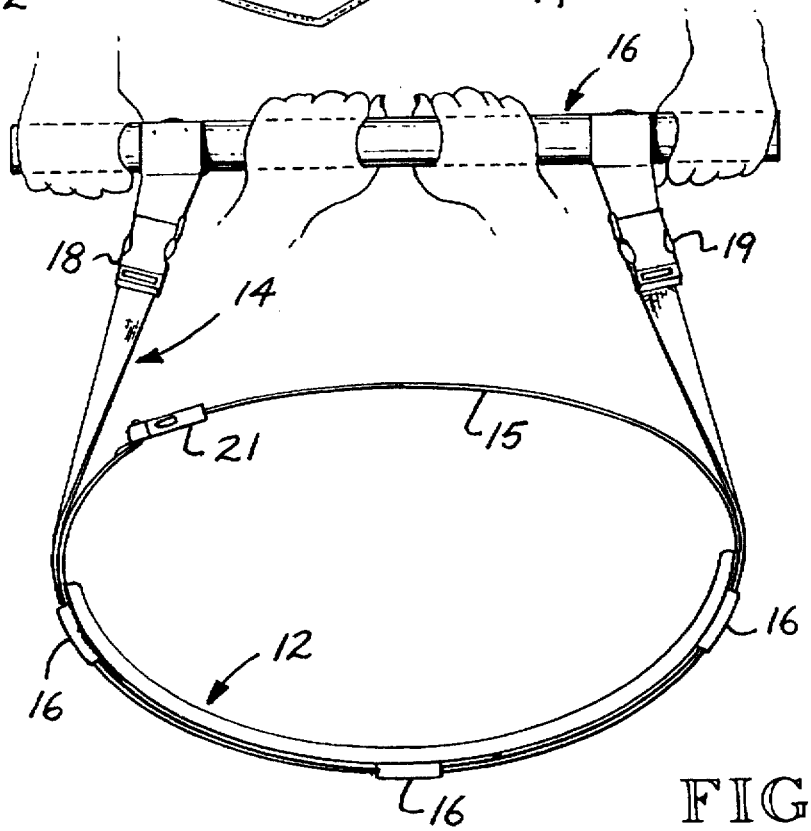
FIG. 6

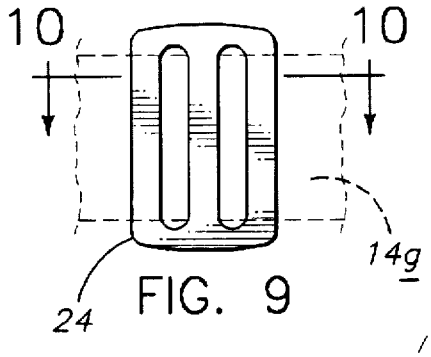
FIG. 9
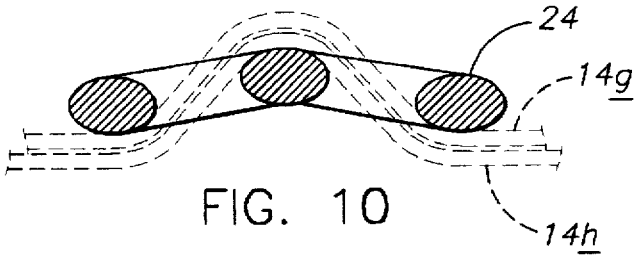
FIG. 10
FIG. 7
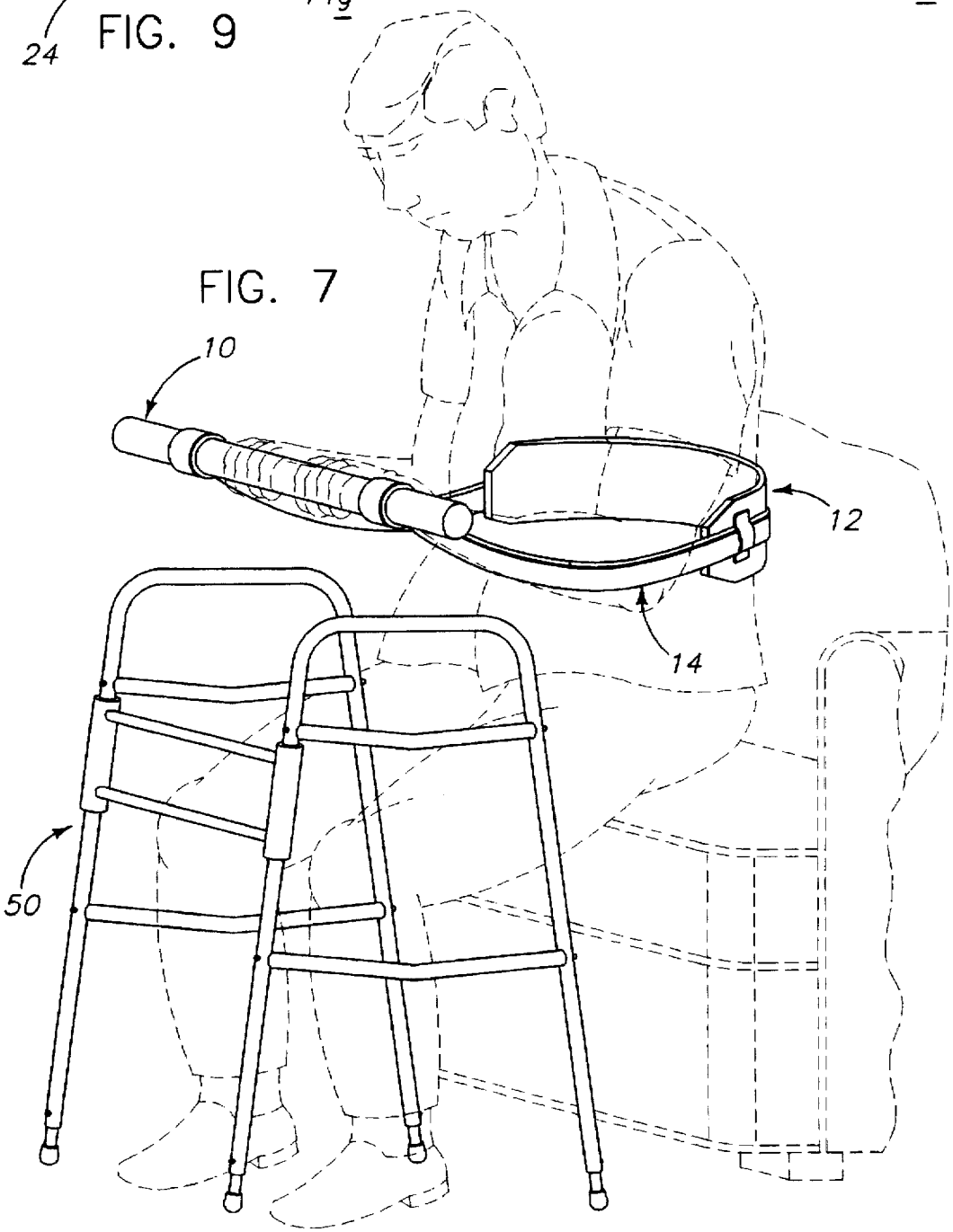

PATIENT TRANSFER ASSIST DEVICE

RELATED APPLICATION

This application is a continuation-in-part of application Ser. No. 08/546,455, filed Oct. 20, 1995, now abandoned.

BACKGROUND OF THE INVENTION

Field of the Invention

This invention relates to devices to assist persons in transferring between sitting and standing positions. More particularly, this invention relates to sling-type devices used by an attendant to pull a person from a sitting to a standing position or to lower a person from a standing to a sitting position.

Brief Description of the Prior Art

Many individuals do not have the physical strength to transfer from a sitting to a standing position. Therefore, they require some assistance in rising to the standing position. Once, standing, however, they are able to move about safely, with or without a walker or a cane. Likewise, many individuals require similar assistance in transferring from a standing to a sitting position.

Current methods for assisting an individual from transferring from a sitting to a standing position, or from a standing to a sitting position, expose the attendant or the person requiring assistance to injury. Frequently, no assistive device is used and the attendant simply uses the arms of the person requiring assistance to pull or lower the person; subjecting the person's arms and shoulders to potential injury. Also, even where some assistive device is employed, the attendant will frequently be forced to bend forward in order to raise or lower the person requiring assistance; thereby subjecting his or her own back and shoulders to injury.

There are devices available for assisting in such instances. These include belts, lift aids, pneumatic or electric hoists, lift chairs, and the like. Many of the devices are expensive or awkward to use, or inappropriate for use in multiple settings because of size, lack of portability, or the requirement for special accessories. While belts and lift aides are portable and economical, and provide a hand hold for the attendant, other than the arms of the person requiring assistance, they impose poor body mechanics on the attendant. The poor body mechanics of bending forward to reach and pull a sitting person up to a standing position, or to lower a standing person down to a sitting position, remains a serious risk factor for back and shoulder injury to the assisting person.

SUMMARY OF THE INVENTION

A primary object of the present invention is to provide a means for one person to safely assist another person to rise from a sitting position to a standing position, and to lower from a standing position to a sitting position, without injury to either person. The present invention is a device which provides an optimum hand hold, while extending the reach of the assisting person. The potential for injury associated with pulling on a person's arms, and with forward bending and lifting, is eliminated.

In accordance with the invention a person lifting assist device is provided for use to help a person transfer from a sitting position to a standing position and from a standing position to a sitting position which comprises support means for fitting around the lower back and waist of a person to be assisted and grip means secured to the support means at a distance from the person to be assisted so as to enable an attendant to stand before a person to be assisted and to pull such a person from a sitting to a standing position, or to lower such a person from a standing position to a sitting position, while maintaining an upright posture. The support means comprises a strap secured to the grip bar and extending around the lower back and waist of a person to be assisted. The strap has a sufficient length so as to enable an attendant to stand before a person to be assisted and to pull such a person from a sitting position to a standing position, or lowering a person from a standing position to a sitting position, while maintaining an upright posture. The support means preferably also comprises a pad for fitting around the lower back and waist of a person to be assisted, with the strap secured to the pad. The grip means preferably comprises a grip bar having a length sufficient to enable an attendant and the person to be assisted to grip the bar during use of the device.

BRIEF DESCRIPTION OF THE DRAWINGS

FIG. 5 is a perspective view of another embodiment of the device of this invention that includes a waist strap to secure a waist pad to a person in addition to a grip bar and a connecting pulling strap, with both ends of the pulling strap being detachable from the grip bar;

FIG. 6 is a plan view of the component parts of the FIG. 5 device;

FIG. 7 illustrates application of the device of this invention to assist in transferring a person from a sitting position to a standing position in the case where an intervening object is located between the person to be assisted and the assisting attendant, with the pulling strap extended to accommodate the intervening object;

FIG. 9 is a plan view of a strap attachment used in the device of this invention for placement on a strap to confine a free strap end;

FIG. 10 is a cross section taken along the line 10—10 of FIG. 9 illustrating the extension of a strap and the free end of a strap through the strap attachment;

DESCRIPTION OF THE PREFERRED EMBODIMENTS

In its preferred form, the present invention comprises a padded hand-grip bar and a wrap-around sling which is attached to the bar. The sling comprises a cushioned, non-staining, moisture-proof, washable pad securely looped to a nylon webbing strap. The nylon webbing strap is attached to the padded hand grip bar by means of plastic rivets. The grip bar provides a hand hold to both the assisting person and the person requiring assistance during transfer. The sling pad is designed to be placed around a person's lower back and waist. When the grip bar is pulled on by the assisting person, the pulling force extends from the bar to the sling around the sitting person's lower back and waist. This enables the sitting person to arise from a seated position to a standing position while stabilizing himself or herself by holding on to the padded bar during the transfer. Likewise, this enables the standing person to transfer from a standing position to a seated position while stabilizing himself or herself by holding on to the padded bar during the transfer.

Figure 1:
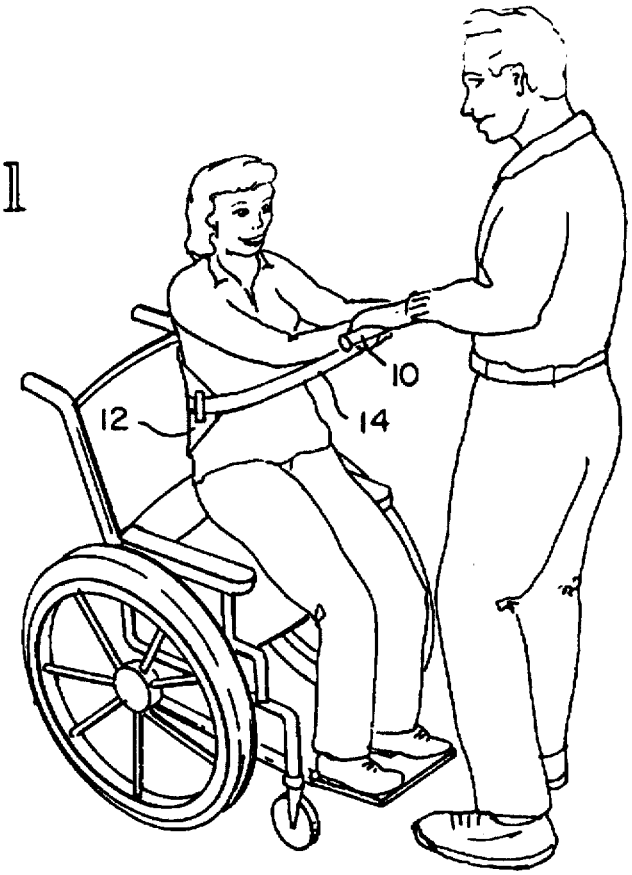
FIG. 1 is a perspective view of an attendant using the device of this invention to assist in transferring a person from a sitting position to a standing position.

To perform a transfer, the assisting person places the padded sling around the sitting person's lower back and waist. The sitting person and the assisting person hold on to the padded hand grip bar as shown in FIG. 1. When ready, the assisting person pulls the bar toward himself or herself while the sitting person uses his or her legs to stand. As this procedure is performed, the device assists in bringing the sitting person's body weight forward and over his or her feet, and also assists in lifting him or her into a standing position. Once the person requiring assistance is standing, the sling and bar assembly may be removed. The reverse procedure is employed to transfer a person from a standing to a sitting position. It is a convenience of the present invention that a walker may be placed in front of a sitting person, between the person requiring assistance and the attendant, and still allowing the attendant to maintain an optimum upright posture and good body mechanics while assisting the person to stand.

As shown in the Figures, the device of the present invention comprises a grip bar 10, a pad 12 and a pulling strap 14 that connects the grip bar to the waist pad. In addition, as shown in FIGS. 5 and 6, the device may also include a waist strap 15 that is attached to the pad 12 for securing the pad 12 around a person's lower back and waist. The pulling strap 14 may be detachably connected to the grip bar by means of one or two buckles, one buckle 18 being shown in FIG. 2 and two buckles 18 and 19 being shown in FIGS. 5 and 6. In either instance where the strap 14 is detachably connected to the grip bar, one or two buckles may be provided in a form that enables the pulling strap 14 to be lengthened and shortened. Likewise, where a waist strap 15 is included, the waist strap may be provided with a buckle 21 in a form that enables the waist strap to be lengthened and shortened.

The bar 10 is preferably covered with a resilient material such as a closed cell foam plastic tubular layer 10*a* so that the bar's outer surface is somewhat compressible. The inner part of the bar 10, then, can be provided by an appropriate material 10*b*, such as metal or plastic, that is either solid or tubular and, if tubular, closed with plastic end caps, such shown in dotted line at 10*c* in FIG. 5.

The strap 14 is preferably fabricated from a nylon webbing material into a narrow, elongated form. The strap 14 is preferably adjustably attached to the waist pad 12 by means of several loops 16 that are secured to the back of the pad 12, as by stitching 16*a*, so that the strap 14 extends through the loops longitudinally across the backside 12*a* of the pad, the frontside 12*b* of the pad being the side that faces the person to be assisted. The pad, being adjustably carried by the strap 14, therefore, may be shifted longitudinally along the strap for a proper fit around the back of the person to be assisted so as to better accommodate the person. Furthermore, by providing attachment loops 16 for securing the strap 14 to the pad 12, a particular sling combination can be adapted by substituting a longer or shorter strap length, keeping the same pad; or by substituting a different pad, keeping the same strap.

Figure 3:
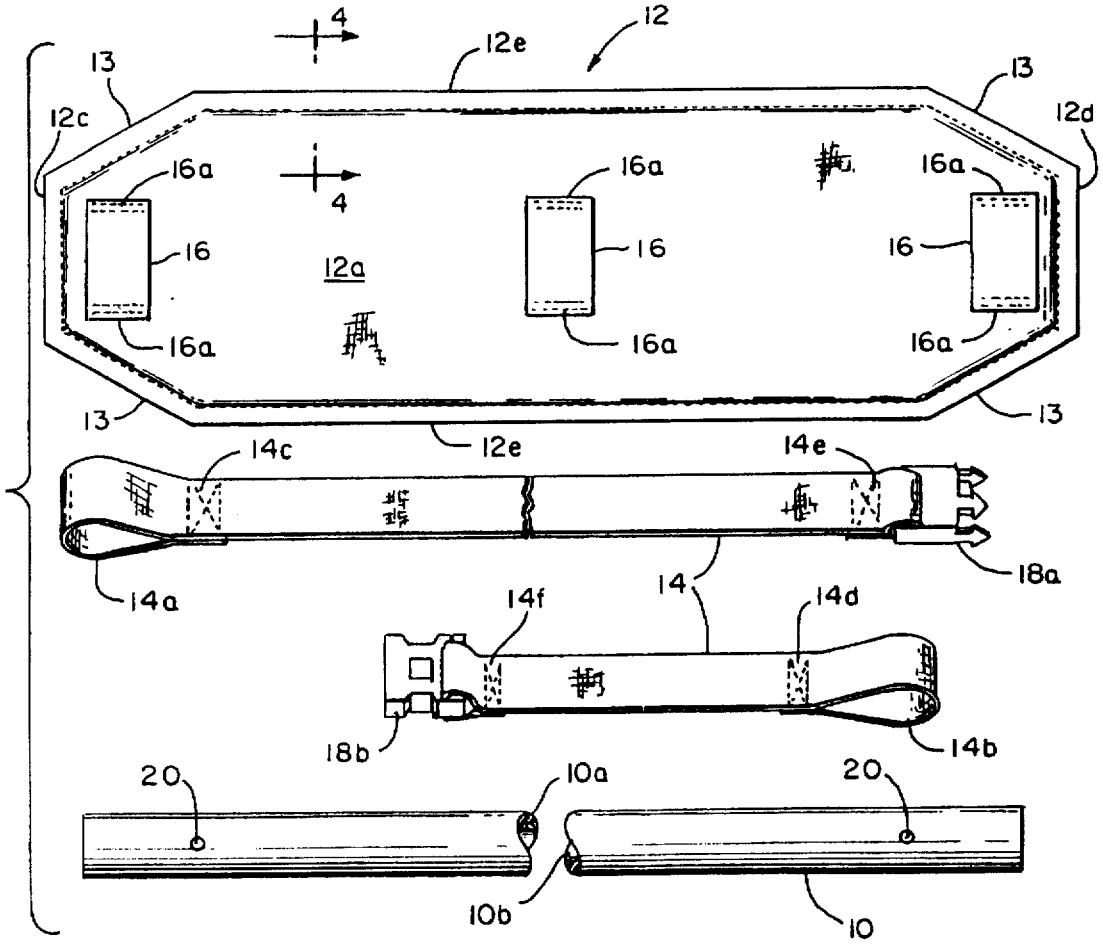
FIG. 3 is a plan view of the component parts of the FIG. 2 device.
Figure 4:
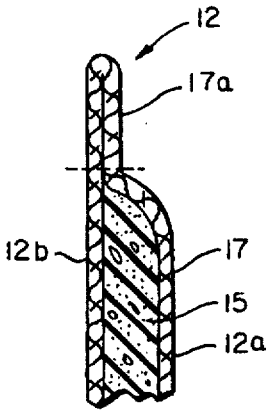
FIG. 4 is a cross section taken along the line 4—4 in FIG. 3.

The pad 12 has a width that is comfortably wide enough to fit across the small of the back of a typical person that would require assistance. The pad 12 has a length that is comfortably long enough to extend across the lower back and the sides of a typical person's waist. The end edges of the pad, 12*c* and 12*d*, as shown in FIGS. 1 and 3, are tapered, as at 13, across the portion of the pad designed to fit around the sides of the person requiring assistance so that the person's hips and arm pits are not inhibited during use. The tapered edges 13 terminate so as to provide outer the ends 12*c*, 12*d* that extend transverse to the longitudinal extent of the pad with a width that is at least as great as the width of the strap 14. The main part of the pad is defined by the parallel linear edges 12*e*, and the pad ends are defined by the tapered edges 13 and transverse edges 12*c*, 12*d*. The main part of the pad is long enough to fit across the lower back of a typical person to be assisted; typically about 18 inches. The end parts of the pad may have a length of about 8 inches each; making a typical pad about 34 inches long. The pad 12 preferably is formed from a cushioned material 15, such as EVA foam, that is encased in a non-staining, moisture-proof, washable fabric 17; fabric 17 being preferably seamed around the periphery of the material 15 as shown at 17*a* in FIG. 3.

Figure 2:
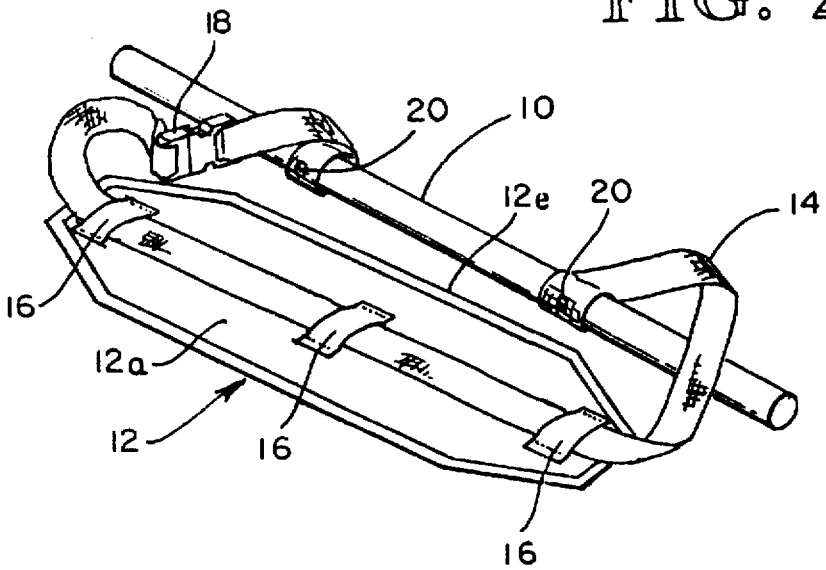
FIG. 2 is a perspective view of one embodiment of the device of this invention comprising a waist pad, a grip bar, and a pulling strap connecting the waist pad to the grip bar.

The strap 14 is preferably provided in two parts joined by a side release buckle 18 as shown in FIGS. 2 and 3, or in three parts joined by two side release buckles 18 and 19 as shown in FIGS. 5 and 6. These side release buckles have a male part, illustrated in FIG. 3 at 18*a*, attached to one part of the strap and a female part, illustrated in FIG. 13 at 18*b*, attached to the other part. The outer ends of each strap part are preferably provided with loops 14*a*, 14*b*, into which the grip bar 10 is inserted. The end loops may be formed by doubling the webbing back on to itself and stitching the overlapped webbing as shown at 14*c*, 14*d* in FIGS. 3 and 5. The loops are preferably riveted to the grip bar so as to be permanently secured to the grip bar. Considering the use of the bar 10 as shown in FIG. 1, the rivets would preferably be located at the bottom of each loop, opposite the person being assisted so that the tensile forces on the loops would be balanced on each leg of each loop to reduce or eliminate any tendency for the strap to twist in the hands of the attendant.

The strap 14 is preferably secured to bar 10 at locations that permit the person to be assisted to grip the bar either inside or outside of the attachment points and the attendant to grip the bar either outside or inside of the attachment points. Thus, the bar must be long enough and the strap attachment points spaced far enough apart that one of the persons can grip the bar between the strap attachment points and the other person can grip the bar between the ends of the bar and the strap attachment points. A convenient and preferred length for bar 10 is 26 inches. A convenient and preferred diameter of bar 10, including the outer compressible cover, is 1.5 inches. In FIG. 1, the person being assisted is shown gripping the bar between the strap attachment points and the attendant is shown gripping the bar toward the ends of the bar between the bar ends and the strap attachment points; it being understood that the gripping locations of the two persons could just as well be reversed.

In normal use, the strap reaches that extend from the pad to the bar preferably extend parallel to one another or slightly in toward one another. Consequently, the ends 12*c*, 12*d* of the pad 12 are drawn in toward one another so that the pad fits snugly around the person being assisted. As shown in FIG. 2, the attachment points between the bar 10 and the strap parts may be spaced apart about the length of the linear part 12*e* of the pad so as to insure that the pad will be drawn around the sides of the person to be assisted.

The buckle parts 18*a* and 18*b* may be secured by extending the webbing through the buckle parts and doubling the webbing back on to itself and stitching the overlapped webbing as shown at 14*e*, 14*f* in FIG. 3. Alternately, either buckle part may be adjustably secured to its respective webbing part so that the effective length of the strap 14 can be lengthened or shortened as shown in FIG. 5 with respect to buckle 19. Whereas FIG. 5 illustrates a free strap end 14*g* extending from buckle 19 in an unconfined manner, it is preferable to fit a slide clasp, such as attachment 24 shown in FIGS. 9 and 10, to the strap 14 to confine the free end 14*g* against the main strap portion 14*h*. Where two buckles are used as shown in FIGS. 5 and 6, either or both buckles may be adjustably secured to its respective webbing part, although only one buckle need to thusly secured to provide for length adjustment of strap 14.

With respect to the embodiment shown in FIGS. 2 and 3, where the strap 14 comprises two parts joined by a single buckle 18, the strap part having loop 14*b* and buckle part 18*b* is preferably short enough that the buckle part 18*b* will be located about midway between the bar and the pad, so that the buckle can be easily connected and disconnected in front of the person to be assisted. Where strap 14 is to be of fixed length, the overall length of strap 14 is preferably about 60 inches.

With respect to the embodiment shown in FIGS. 5 and 6, where the strap 14 comprises three parts joined by two buckles 18, 16, the strap parts having loops 14*a* and 14*b* are preferably short enough that the buckle parts connected to the strap loop parts will be located close to the grip bar 10. By arranging the buckles 18, 19 so that the main strap portion 14*h* will be fitted with a male buckle part, as at 18*a*, on one end and a female buckle part on the other end, the two ends of portion 14*h* may be locked together, after the grip bar 10 is detached. With this configuration, the strap portion 14*h* could be wrapped back around the back of a chair to secure the pad to the chair. In the case where the device of this invention is also provided with a waist strap 15, when the waist strap is secured about a person and the pulling strap portion 14*h* is wrapped around a chair back and its ends locked together, a person could be restrained in the chair. Consequently, an attendant could use the device to lower a person requiring assistance into a chair and then, after detaching the grip bar 10, could fasten the freed ends of the pulling strap portion 14*h* around the back of the chair to hold the person in the chair. This would permit the attendant to leave the person requiring assistance unattended for a period of time in a secure position.

The pulling strap and the waist strap, if provided, are preferably fabricated from 2 inch wide and 1/16th inch thick nylon webbing. The buckles are marketed under the trademark NEXUS.

Figure 11:
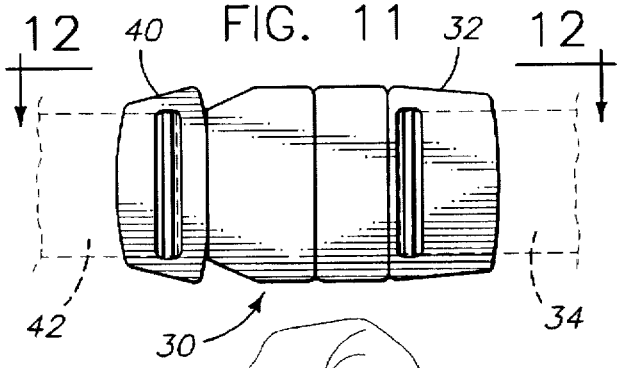
FIG. 11 is a plan view of side release buckle used in the device of this invention to enable a strap length to be lengthened and shortened.
Figure 12:
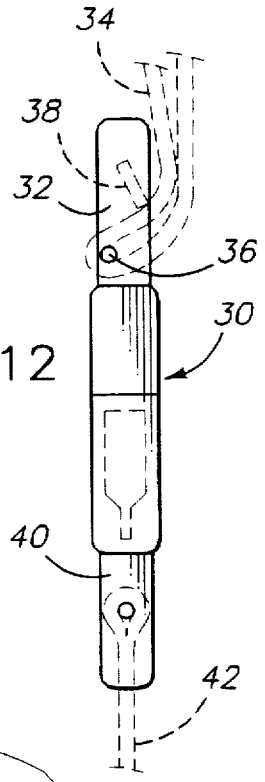
FIG. 12 is a cross section taken along the line 12—12 of FIG. 11 illustrating the connection of the buckle to two strap segments.

The pad/strap sling combination illustrated in FIG. 3 can be easily assembled, because of the provision of the attachment loops 16, by inserting loop 14*a* or male buckle part 18*a* through the loops 16 and then fastening the buckle parts together. In the assembly sequence of the pad/strap combination, the bar 10 normally would be attached to the strap after the pad was installed on the strap. However, by providing the attachment loops 16 with sufficient width to accommodate the male buckle part 18*a*, the pad could be removed from the strap if such were desired even though the strap were riveted to the bar. The pad/strap combination illustrated in FIG. 5, where main strap portion 14*h* has a free end 14*g*, that free end 14*g* may be extended through the loops 16 during assembly of the device and then attached to the buckle 19.

Where one or more of the buckles 18, 19, 21 are provided with means for having a strap 14 or 14 adjustably connected thereto, the buckle configuration shown in FIGS. 11 and 12 would be appropriate. In this configuration, a buckle 30 is provided with a self-locking assembly 32 that enables a strap portion 34 to be threaded around a pin 36 and engaged against a restraining bar 38. When the strap 34 is pulled taut, it is wedged against the bar 30 so that strap will remain stationary about the pin 36. A NEXUS buckle is available with such a configuration called a ladderlock assembly. The other end 40 of the buckle is fastened to a strap portion 42 in a conventional manner.

Where a waist strap 15 is provided, as shown in FIGS. 5 and 6, the waist strap is preferably fastened to the pad 12 as by being stitched to the back face of the pad as at 15*a* in FIG. 5. The waist strap 15 could be stitched to the pad 12 at one or more locations, such as under each loop 16. By locating the loops 16 around the waist strap as shown in FIG. 5, the pulling strap 14 will be located coincidently with the waist strap, providing a more pleasing appearance to the back of the pad 12.

Figure 8:
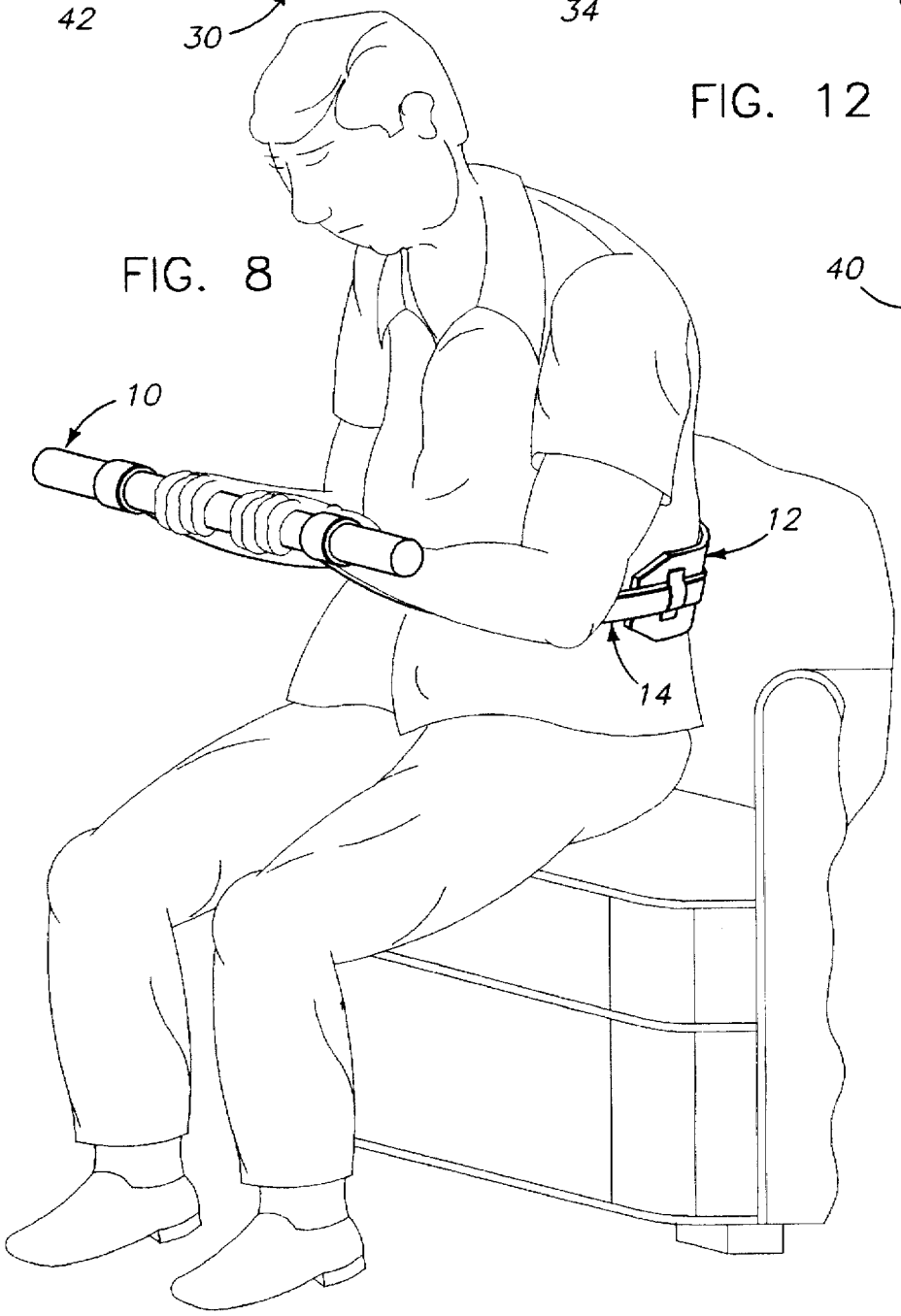
FIG. 8 illustrates an application of the device similar to FIG. 7 except that no intervening device is present, with the pulling strap shortened so as to reduce the distance between the person to be assisted and the assisting attendant.

In either the FIG. 2 or the FIG. 5 embodiment, the pulling strap 14 may be extended through two, three or more loops 16. Because the pad 12 may be moved along the pulling strap 14, or alternately the strap 14 may be moved relative to the pad 12, the strap—pad relationship can be adjusted as required. FIGS. 7 and 8 illustrate the desirability of this feature.

Taking FIGS. 7 as an example, where the device is the FIG. 5 embodiment, the length of pulling strap part 14*h* can be lengthened through a NEXUS ladderlock side release buckle 19 so that an attendant can assist a person to rise from a chair into a standing position with a patient walker-assist device 50 located between the two persons. When the strap 14 is lengthened, the strap can be adjusted relative to the pad 12 so that the two reaches of the strap from either end of the pad 12 will be the same length. Consequently, a walker-assist device can be placed before a person requiring assistance and an attendant can pull that person into a standing position so that the person can conveniently grip the walker-assist device handles. By providing for lengthening the pulling strap 14, the attendant can maintain proper posture for safely pulling a person into a standing position, or lowering a person from a standing to a sitting position, even though there is an intervening object, such as a walker-assist device. Now taking FIG. 8 as an example, where the device is the FIG. 5 embodiment, the length of the pulling strap part 14*h* can be shortened through a NEXUS ladderlock side release buckle 19 so that an attendant can assist a person to rise from a chair into a standing position, or lower into a chair from a standing position, with no intervening object while maintaining proper body mechanics; with the relative positions of the pulling strap 14 and the pad 12 being adjusted to accommodate and balance shorter strap reaches. In both the FIG. 7 and 8 examples, the person requiring assistance is able to grip the grip bar 10 to steady and aid himself or herself, whether the pulling strap 14 is lengthened as in FIG. 7 or shortened as in FIG. 8.

While the preferred embodiments of the invention has been described herein, variations in the design may be made.

For example, pads of different lengths and widths can be employed depending on the size of the person requiring assistance; and such pads may or may not have tapered side edges. The strap need not be adjustably attached to the backside of the pad; but rather may be fixedly secured to the pad or it may be composed of two parts that are each secured to the pad as, for example, at the pad edges. Under appropriate circumstances, the support means may be composed of the strap by itself, either with or without an enlarged portion that would fit around a person's lower back and waist; the strap, of course, being provided with appropriate end portions for attaching to the grip bar. The scope of the invention, therefore, is only to be limited by the claims appended hereto.

The embodiments of the invention in which an exclusive property is claimed are defined as follows:

1. A person transfer assist device for use to help a person transfer from a sitting position to a standing position and from a standing position to a sitting position which comprises:

a) a pad for fitting around the lower back and waist of a person to be assisted;

b) a grip bar having length to enable both an attendant and the person to be assisted to grip the bar during use of the device; and c) a strap secured to said pad and to said grip bar, said strap having a length so as to enable an attendant to stand before a person to be assisted and to pull such a person from a sitting position to a standing position, or to lower such a person from a standing position to a sitting position, while maintaining an upright posture, when said pad is fitted around the person's lower back and waist.

2. The device of claim 1 wherein said pad is provided with multiple attachment loops through which said strap is extended so as to secure said waist pad to said strap.

3. The device of claim 1 wherein said strap is provided in two parts and wherein releasible buckle means detachably joins the strap parts together so that the strap parts can be disconnected from one another.

4. The device of claim 1 wherein said strap is provided in three parts and wherein releasible buckle means detachably joins the strap parts together so that the strap parts can be disconnected from one another; two of said parts being permanently fastened to said grip bar and the third of said parts being secured to said pad.

5. The device of claim 1 wherein said pad is provided with multiple attachment loops through which said strap is extended so as to secure said pad to said strap; and wherein said strap is provided in parts and wherein releasible buckle means is detachably joins the strap parts together so that the strap parts can be disconnected from one another.

6. A person transfer assisting device for use to help a person transfer from a sitting position to a standing position and from a standing position to a sitting position which comprises:

a) a pad for fitting around the lower back and waist of a person to be assisted;

b) a grip bar; and c) strap means secured to said pad and to said grip bar, said strap means having a length so as to enable an attendant to stand before a person to be assisted and to pull such a person from a sitting position to a standing position, or to lower such a person from a standing position to a sitting position, while maintaining an upright posture, when said pad is fitted around the person's lower back and waist.

7. The device of claim 6 wherein said pad is provided with multiple attachment loops through which said strap means is extended so as to secure said pad to said strap means.

8. The device of claim 6 wherein said strap means is provided in two parts and wherein releasible buckle means detachably joins the strap parts together so that the strap parts can be disconnected from one another.

9. The device of claim 6 wherein said strap is provided in three parts and wherein releasible buckle means detachably joins the strap parts together so that the strap parts can be disconnected from one another; two of said parts being permanently fastened to said grip bar and the third of said parts being secured to said pad.

10. The device of claim 6 wherein said pad is provided with multiple attachment loops through which said strap means is extended so as to secure said pad to said strap means; and wherein said strap means is provided in parts and wherein releasible buckle means detachably joins the strap parts together so that the strap parts can be disconnected from one another.

11. A person transfer assist device for use to help a person transfer from a sitting position to a standing position and from a standing position to a sitting position which comprises:

a) support means for fitting around the lower back and waist of a person to be assisted and to enable an attendant to pull such a person from a sitting position to a standing position, or to lower such a person from a standing position to a sitting position; and b) a grip bar secured to said support means at a distance from the person to be assisted so as to enable an attendant to stand before a person to be assisted when pulling such a person from a sitting position to a standing position, or when lowering such a person from a standing position to a sitting position, while maintaining an upright posture, when said support means is fitted around the person's lower back and waist.

12. The device of claim 11 wherein said support means comprises a pad for fitting around the lower back and waist of a person to be assisted, and a strap secured to the pad and to the grip bar, the strap having a length so as to enable an attendant to stand before a person when pulling on the grip bar while maintaining an upright posture.

13. The device of claim 12 wherein said pad is provided with multiple attachment loops through which said strap is extended so as to secure said waist pad to said strap.

14. The device of claim 12 wherein said strap is provided in two parts and wherein releasable buckle means detachably joins the strap parts together so that the strap parts can be disconnected from one another.

15. The device of claim 12 wherein said strap is provided in three parts and wherein releasible buckle means detachably joins the strap parts together so that the strap parts can be disconnected from one another; two of said parts being permanently fastened to said grip bar and the third of said parts being secured to said pad.

16. The device of claim 12 wherein said pad is provided with multiple attachment loops through which said strap is extended so as to secure said pad to said strap; and wherein said strap is provided in parts and wherein releasible buckle means detachably joins the strap parts together so that the strap parts can be disconnected from one another.

17. A person transfer assisting device for use to help a person transfer from a sitting position to a standing position and from a standing position to a sitting position which comprises:

a) a pad for fitting around the lower back and waist of a person to be assisted;

b) a grip bar;

c) pulling strap means secured to said pad and to said grip bar, said strap means having a length so as to enable an attendant to stand before a person to be assisted and to pull such a person from a sitting position to a standing position, or to lower such a person from a standing position to a sitting position, while maintaining an upright posture, when said pad is fitted around the person's lower back and waist; and d) waist strap means secured to said pad for attaching said pad to the lower back and waist of a person to be assisted.

18. The device of claim 17 wherein said pad is provided with multiple attachment loops through which said pulling strap means and said waist strap means are extended with said pad being moveable along said pulling strap means.

19. The device of claim 17 wherein said pulling strap means is provided in three parts and wherein releasible buckle means detachably join the strap parts together so that the strap parts can be disconnected from one another; two of said parts being permanently fastened to said grip bar and the third of said parts being secured to said pad.

20. The device of claim 17 wherein said pulling strap means is provided in three parts and wherein releasible buckle means detachably join the strap parts together so that the strap parts can be disconnected from one another; two of said parts being permanently fastened to said grip bar and the third of said parts being secured to said pad.

* * * * *